US005940022A

United States Patent [19]

Takatsu

[11] Patent Number: 5,940,022

[45] Date of Patent: Aug. 17, 1999

[54] ELECTROMAGNETIC WAVE ABSORBER

[75] Inventor: Katsumi Takatsu, Saitama-ken, Japan

[73] Assignee: Zexel Corporation, Tokyo, Japan

[21] Appl. No.: 09/055,918

[22] Filed: Apr. 7, 1998

[30] Foreign Application Priority Data

Apr. 10, 1997 [JP] Japan ..... 9-092512
Apr. 15, 1997 [JP] Japan ..... 9-097595

[51] Int. Cl.[6] ..... H01Q 17/00
[52] U.S. Cl. ..... 342/1
[58] Field of Search ..... 342/1, 2, 3, 4; 426/107, 113, 243; 428/328; 219/744

[56] References Cited

U.S. PATENT DOCUMENTS 4,024,318 5/1977 Forster et al. ..... 342/1
4,970,360 11/1990 Pesheck et al. ..... 426/107
5,258,596 11/1993 Fabish et al. ..... 426/107
5,770,304 6/1998 Nakamura et al. ..... 428/328

*Primary Examiner*—Daniel T. Pihulic
*Attorney, Agent, or Firm*—Kanesaka & Takeuchi

[57] ABSTRACT

An electromagnetic wave absorber comprises a substrate made from a material which rarely absorbs a microwave and an electromagnetic wave absorbing layer formed on the surface of the barrier of the substrate, the electromagnetic wave absorbing layer is made from a mixture of an electro-conductive metal oxide and an insulating material, and the impedance of the electromagnetic wave absorbing layer is adjusted to the impedance of a medium through which the microwave is transmitted such that reflection power ratio becomes 10 dB or more.

7 Claims, 3 Drawing Sheets

ELECTROMAGNETIC WAVE ABSORBER

BACKGROUND OF THE INVENTION

1. Field of the Invention

The present invention relates to an electromagnetic wave absorber for absorbing a microwave effectively and converting it into heat energy and, particularly, to an electromagnetic wave absorber which can be used at high temperatures.

2. Description of the Prior Art

An N type semiconductor material has been available as an electromagnetic wave absorbing material having high microwave absorbing power. This material exhibits a high resistance value at normal temperature but its resistance value sharply drops at high temperatures. Therefore, in an electromagnetic wave absorber made from the above material as a load, the impedance of the load sharply changes along with temperature variations and a microwave cannot be absorbed effectively at a wide temperature range. Electromagnetic wave absorbers which can absorb a microwave effectively even at high temperatures include oxides of metals such as zinc, manganese and cobalt and mixtures of two or more of these metal oxides.

A conventional coated electromagnetic wave absorber can be obtained by coating the above metal oxide on the surface of each barrier of a substrate made from a material which has a honeycomb structure, is essentially composed of alumina, zirconia or the like and rarely absorbs a microwave to form an electromagnetic wave absorbing layer. When this electromagnetic wave absorber is irradiated with a microwave, the microwave is absorbed and converted into heat energy by an metal oxide forming the above electromagnetic wave absorbing layer.

However, the impedance of propagation space determined by the frequency of the propagating microwave (electromagnetic wave) and a medium through which the microwave propagates is not taken into account in the design of the conventional electromagnetic wave absorber. Therefore, the impedance of the electromagnetic wave absorber does not match the impedance of the propagation space. Accordingly, a microwave is reflected upon the surface of the conventional electromagnetic absorber, resulting in a reduction in the absorption efficiency of the microwave. When the metal oxide is coated by a sol-gel process, CVD process or PVD process to form an electromagnetic wave absorbing layer, the impedance of the electromagnetic wave absorbing layer becomes lower than the impedance of the powdery metal oxide as the raw material, and the microwave having a GHz band is greatly reflected. Therefore, the microwave cannot be absorbed efficiently.

When the material forming the above electromagnetic wave absorbing layer contains Co and the material forming the substrate contains Al like a cordierite sintered body essentially composed of MgO or $Al_2O_3$, Co and Al react with each other at high temperatures, whereby the composition ratio of the electromagnetic wave absorbing layer differs from the initial composition ratio with the result of a reduction in the electromagnetic wave absorption efficiency of the electromagnetic wave absorber. Also when the material forming the electromagnetic wave absorbing layer contains Mn and the material forming the substrate contains Si like a composite oxide of $SiO_2$ and MgO, the same reaction occurs with the result of a reduction in the electromagnetic wave absorption efficiency of the electromagnetic wave absorber.

SUMMARY OF THE INVENTION

It is an object of the present invention which has been made in view of the above problems of the prior art to provide an electromagnetic wave absorber which absorbs a microwave effectively and converts it into heat energy and is capable of absorbing a microwave effectively at a wide temperature range.

According to a first aspect of the present invention, there is provided an electromagnetic wave absorber comprising a substrate made from a material which rarely absorbs a microwave and an electromagnetic wave absorbing layer formed on the surface of each barrier of the substrate, wherein the electromagnetic wave absorbing layer is made from a mixture of an electroconductive metal oxide and an insulating material, and the impedance of the electromagnetic wave absorbing layer is adjusted to the impedance of a medium through which the microwave is transmitted such that reflection power ratio becomes 10 dB or more (reflection power is about 1/10 or less of input power).

According to a second aspect of the present invention, there is provided an electromagnetic wave absorber, wherein the electromagnetic wave absorbing layer is formed by coating on the surface of the substrate a slurry prepared by mixing 0.1 to 60 wt % of the insulating material powders with the electroconductive metal oxide fine powders in a solvent.

According to a third aspect of the present invention, there is provided an electromagnetic wave absorber, wherein the electroconductive metal oxide fine powders have an average particle diameter of 0.1 to 10 $\mu$m and the insulating material powders have an average particle diameter of 0.1 to 500 $\mu$m.

According to a fourth aspect of the present invention, there is provided an electromagnetic wave absorber, wherein the substrate is composed of a ceramic sintered body having insulating properties and high thermal shock resistance, such as a cordierite sintered body.

According to a fifth aspect of the present invention, there is provided an electromagnetic wave absorber, wherein an intermediate layer made from a metal oxide containing no component which reacts with a metal element component contained in the electromagnetic wave absorbing layer at high temperatures is formed between the electromagnetic wave absorbing layer and the substrate.

"High temperatures" as used herein means temperatures at which the electromagnetic wave absorber is heated by microwave radiation, that is, about 500 to 800° C.

According to a sixth aspect of the present invention, there is provided an electromagnetic wave absorber, wherein a metal oxide containing no Al such as $SiO_2$, $ZrO_2$ or $CeO_2$, or a composite metal oxide of two or more thereof is used to form the intermediate layer when the electromagnetic wave absorbing layer is made from an electroconductive metal oxide containing Co.

According to a seventh aspect of the present invention, there is provided an electromagnetic wave absorber, wherein a metal oxide containing no Si such as CaO, $Al_2O_3$ or $CeO_2$, or a composite metal oxide of two or more thereof is used to form the intermediate layer when the electromagnetic wave absorbing layer is made from an electroconductive metal oxide containing Mn.

The above and other objectives, features and advantages of the invention will become more apparent from the following description when taken in conjunction with the accompanying drawings.

DETAILED DESCRIPTION OF THE PREFERRED EMBODIMENTS

Preferred embodiments of the present invention will be described hereinunder with reference to the accompanying drawings.

Embodiment 1

Figure 1A:
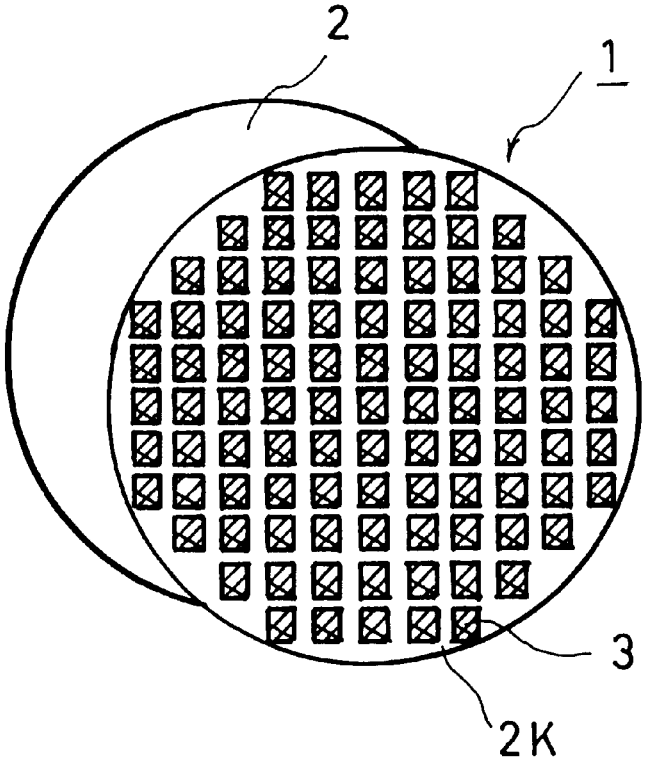
FIGS. 1(*a*) and 1(*b*) are diagrams showing the structure of an electromagnetic wave absorber according to Embodiment 1 of the present invention.
Figure 1B:
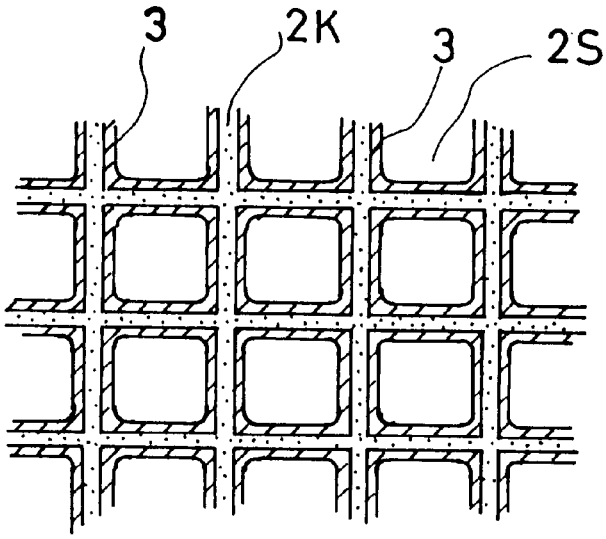

FIGS. 1(*a*) and 1(*b*) show the structure of an electromagnetic wave absorber according to Embodiment 1 of the present invention. The electromagnetic wave absorber 1 comprises a substrate 2 composed of a cordierite sintered body having a honeycomb structure, insulating properties and high thermal shock resistance, and an electromagnetic wave absorbing layer 3 coated on the surface of each barrier 2K of the substrate 2. In FIG. 1B, reference symbol 2S is a honeycomb-structured space portion.

The above electromagnetic wave absorbing layer 3 made from a mixture of $La_{0.6}Sr_{0.4}CoO_3$ which is an electroconductive metal oxide having high heat resistance and MgO which is an insulating material. The mixing ratio of the electroconductive metal oxide to the insulating material is designed to adjust the impedance of the electromagnetic wave absorber 1 coated with the electromagnetic wave absorbing layer 3 to the impedance of the free space through which a microwave is transmitted to such that reflection power ratio becomes 10 dB or more.

A process for forming the electromagnetic wave absorber 1 will be described hereinunder.

In Embodiment 1 of the present invention, $La_{0.6}Sr_{0.4}CoO_3$ fine powders having an average particle diameter of 1 $\mu$m and synthesized by a coprecipitation method are used as the electroconductive metal oxide and MgO powders having an average particle diameter of 4 $\mu$m are used as the insulating material. 80 wt % of the $La_{0.6}Sr_{0.4}CoO_3$ fine powders and 20 wt % of the MgO powders are mixed together in ethanol by a ball mill to prepare a slurry as an electromagnetic wave absorbing material. Thereafter, the substrate 2 composed of a cordierite sintered body having a honeycomb structure is immersed in the slurry and pulled up to dip coat the electromagnetic wave absorbing material on the substrate 2. Right after the substrate 2 is pulled up, the slurry excessively adhered to the barrier 2K of the substrate 2 is blown off gently by air. Thereafter, the substrate 2 is dried with hot air heated at about 80° C. for 30 minutes while it is rotated and heated in the air at about 900° C. for 2 hours to firmly fix the electromagnetic wave absorbing material adhered to the barrier 2K of the substrate 2. Thus, an electromagnetic wave absorbing layer 3 is formed.

Figure 2A:
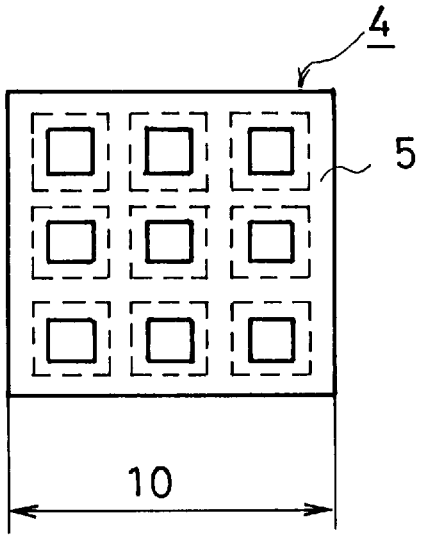
FIGS. 2(*a*) and 2(*b*) are diagrams showing a sample for the resistance measurement of the electromagnetic wave absorber of Embodiment 1.
Figure 2B:
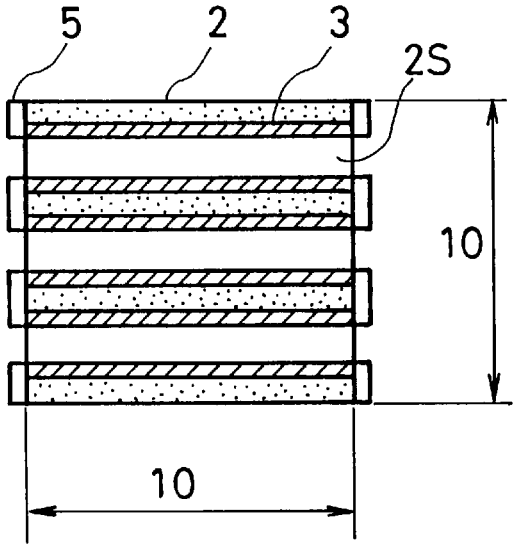

The resistance value of the thus obtained electromagnetic wave absorber 1 is measured by a DC 4-terminal method by cutting out a cubic sample 4 from the electromagnetic wave absorber 1 and attaching a platinum electrode 5 to both sides of the substrate 2, as shown in FIGS. 2(*a*) and 2(*b*). The DC resistance of the 10 $mm^3$ cubic sample shown in FIGS. 2(*a*) and 2(*b*) was about 4 kΩ.cm.

Figure 3:
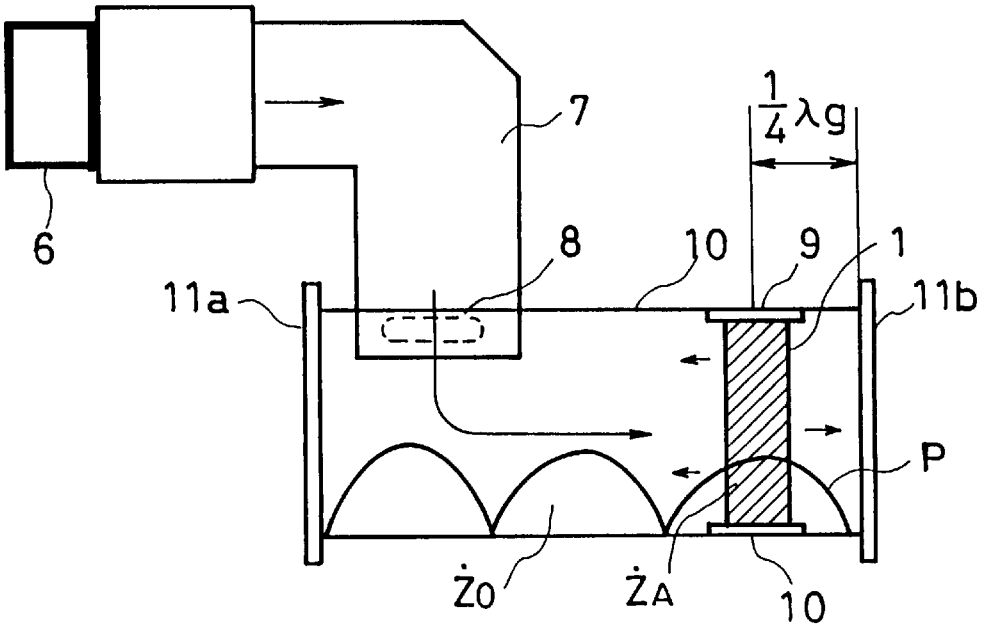
FIG. 3 is a diagram showing an example of the measurement of the heat energy conversion efficiency of the electromagnetic wave absorber of Embodiment 1.

The thus obtained electromagnetic wave absorber 1 is installed in a propagation path of a microwave to measure the heat energy conversion efficiency of the electromagnetic wave absorber 1. FIG. 3 shows an example of the measurement of the heat energy conversion efficiency of the electromagnetic wave absorber 1. A microwave generated by a high-frequency oscillator 6 passes from a waveguide path 7 through a joint slot 8 to a single-mode cylindrical cavity 9 which is a cylindrical propagation path. The electromagnetic wave absorber 1 is fixed in the single-mode cylindrical cavity 9 at a predetermined position by a fixing material 10. Reflection plates 11*a* and 11*b* made from a punching metal are installed at both ends of the single-mode cylindrical cavity 9. The microwave input into the cavity 9 resonates in the cavity 9. In FIG. 3, reference letter P indicates the field strength of a standing wave in the cavity 9, and the electromagnetic wave absorber 1 is fixed at a position of about λg/4 (λg is a wavelength within the waveguide) from the reflection plate 11*b* in the cavity 9. The sizes of the electromagnetic wave absorber 1 and the cavity 9 are determined to adjust the impedance ZA of the electromagnetic wave absorber 1 to the impedance Zo of free space in the single-mode cylindrical cavity 9 such that reflection power ratio becomes 10 dB or more.

The electromagnetic wave absorber 1 is installed in the single-mode cylindrical cavity 9 at a predetermined position (near λg/4), that is, a position where the field strength P of the standing wave becomes maximum, and a microwave having a frequency of 2.45 GHz and generated by the high-frequency oscillator 6 is projected onto the electromagnetic wave absorber 1. When the reflection power of the microwave was measured at a surface temperature of the electromagnetic wave absorber 1 of from room temperature to 800° C., it was found that the electromagnetic wave absorber 1 converted 90 to 95% of the input microwave power into heat energy.

According to this Embodiment 1 of the present invention, since the impedance ZA of the electromagnetic wave absorbing layer 3 is adjusted to the impedance Zo of the medium through which the microwave propagates such that reflection power ratio becomes 10 dB or more (ZA=Zo), the reflection coefficient Γ of the electromagnetic wave absorbing layer 3 can be reduced to 0.1 or less based on the equation of normalized impedance $ZN=(1+\Gamma)/(1-\Gamma)=ZA/Zo$. Therefore, the irradiated microwave can be absorbed and converted into heat energy effectively.

Since $La_{0.6}Sr_{0.4}CoO_3$ which is an electroconductive metal oxide having high heat resistance is used as the electromagnetic wave absorbing material and a cordierite sintered body having insulating properties and high thermal shock resistance is used as the material of the substrate 2, the electromagnetic wave absorber 1 can absorb a microwave stably at a wide temperature range without deterioration such as cracking even when the temperature of the electromagnetic wave absorber 1 rises sharply.

$La_{0.6}Sr_{0.4}CoO_3$ which is an electroconductive metal oxide having high heat resistance is used as the electromagnetic wave absorbing material and MgO is used as the insulating material in this Embodiment 1 of the present invention. When one composite metal oxide or a mixture of two or more composite metal oxides such as $La_{(1-x)}Sr_xCoO_3$, $La_{(1-x)}Sr_xCrO_3$, $La_{(1-x)}Sr_xMnO_3$, $La_{(1-x)}Sr_xCo_{(1-y)}Pd_yO_3$ and $La_{(1-x)}Sr_xMn_{(1-y)}Pd_yO_3$ ($0<x<1$, $0<y<1$) is used and steatite, forsterite, zirconia, alumina, ceria or the like is used as the insulating material having low reactivity with these electroconductive metal oxides even at high temperatures, the same effect as above can be obtained.

Embodiment 2

Figure 4:
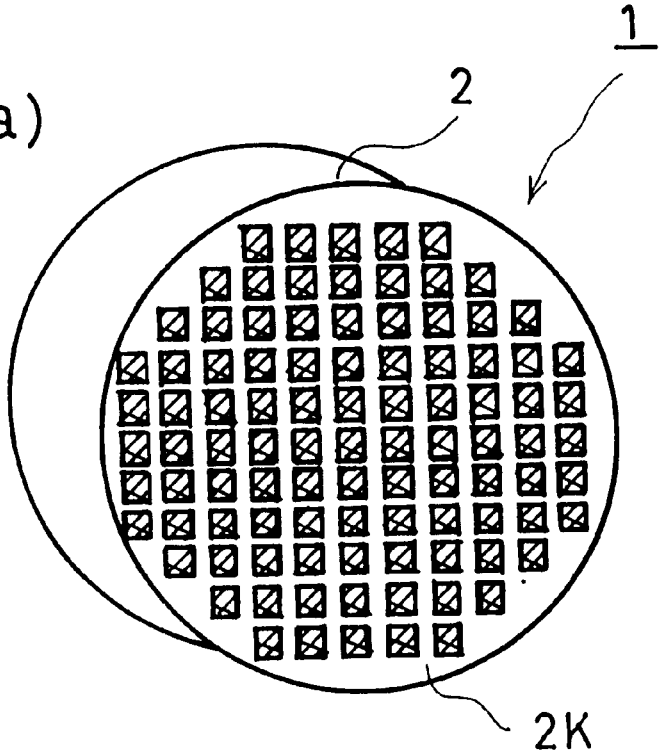
FIGS. 4(*a*) and 4(*b*) are diagrams showing the structure of an electromagnetic wave absorber according to Embodiment 2 of the present invention.
Figure 4:
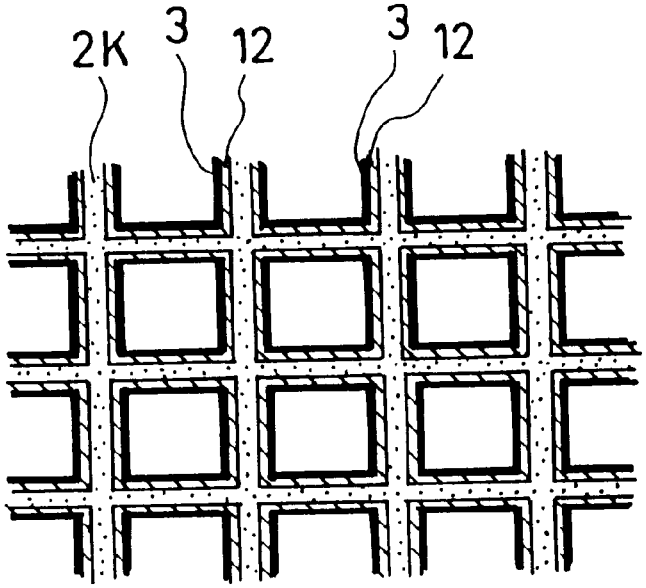

FIGS. 4(*a*) and 4(*b*) are diagrams showing the structure of an electromagnetic wave absorber 1 according to Embodiment 2 of the present invention. The electromagnetic wave absorber 1 comprises a substrate 2 composed of a cordierite sintered body having a honeycomb structure and essentially composed of MgO and $Al_2O_3$ and having insulating properties and high thermal shock resistance, an intermediate layer 12 formed on the surface of each barrier 2K of the substrate 2 and made from $ZrO_2$, and an electromagnetic wave absorbing layer 3 formed on the intermediate layer 12 and made from a mixture of $La_{0.6}Sr_{0.4}CoO_3$ which is an electroconductive metal oxide containing Co and $CeO_2$ which is an insulating material. When the electromagnetic wave absorber 1 was irradiated with a microwave having an output power of 600 W and a frequency of 2.45 GHz, the surface temperature thereof reached about 800° C. in 15 seconds. Even when the temperature of the electromagnetic wave absorber 1 was raised to about 800° C. repeatedly under the above conditions, the temperature rise characteristics of the electromagnetic wave absorber 1 almost remained unchanged and the electric resistance of the electromagnetic wave absorbing layer 3 did not change after a repeated temperature rise test.

When the electromagnetic wave absorbing layer was made from a material containing Mn, such as $La_{0.6}Sr_{0.4}MnO_3$, and the substrate 2 was made from a material containing Si, such as a composite oxide of $SiO_2$ and MgO, a metal oxide containing no Si such as $Al_2O_3$ was used to form the intermediate layer 12, whereby the electromagnetic absorbing layer 3 did not change its properties and the heat conversion efficiency of the electromagnetic wave absorber 1 did not lower even when the temperature of the electromagnetic wave absorber 1 was raised to about 950° C.

According to this Embodiment 2 of the present invention, since $ZrO_2$, a metal oxide containing no Al, is used to form the intermediate layer 12 between the electromagnetic absorbing layer 3 and the substrate 2 when the electromagnetic absorbing layer 3 is made from a material containing Co and the substrate 2 is made from a material containing Al, and $Al_2O_3$, a metal oxide containing no Si, is used to form the intermediate layer 12 when the electromagnetic absorbing layer 3 is made from a material containing Mn and the substrate is made from a material containing Si. Therefore, the electromagnetic absorbing material does not change its properties and the heat conversion efficiency of the electromagnetic wave absorber does not lower even when the temperature of the electromagnetic wave absorber is raised to about 950° C. by microwave radiation.

In this Embodiment 2, the electromagnetic wave absorbing layer may be made from $La_{(1-x)}Sr_xCoO_3$, $La_{(1-x)}Sr_xCo_{(1-y)}Pd_yO_3$ or $La_{(1-x)}Sr_xMn_{(1-y)}Pd_yO_3$($0<x<1$, $0<y<1$). Further, the intermediate layer may be made from a metal oxide containing no Al, such as $ZrO_2$, MgO, $SiO_2$, CaO or $CeO_2$, a composite oxide of two or more thereof, a metal oxide containing no Si, such as $Al_2O_3$, Mgo, $ZrO_2$, CaO or $CeO_2$, or a composite oxide of two or more thereof.

As described above, the electromagnetic wave absorber according to the first aspect of the present invention comprises a substrate made from a material which rarely absorbs a microwave and an electromagnetic wave absorbing layer formed on the surface of the substrate, the electromagnetic wave absorbing layer is made from a mixture of an electroconductive metal oxide and an insulating material, and the impedance of the electromagnetic wave absorbing layer is adjusted to the impedance of a medium through which a microwave is transmitted such that reflection power ratio becomes 10 dB or more. Therefore, the microwave is rarely reflected and can be therefore absorbed and converted into heat energy effectively by the electromagnetic wave absorber.

In the electromagnetic wave absorber according to the second aspect of the present invention, the electromagnetic wave absorbing layer is formed by dip coating on the surface of the substrate a slurry prepared by mixing 0.1 to 60 wt % of the insulating material powders with the electroconductive metal oxide fine powders in a solvent. Therefore, a microwave can be absorbed stably at a wide temperature range and the impedance of the electromagnetic wave absorber can be controlled without fail.

In the electromagnetic wave absorber according to the third aspect of the present invention, the electroconductive metal oxide fine powders have an average particle diameter of 0.1 to 10 $\mu$m and the insulating material powders have an average particle diameter of 0.1 to 500 $\mu$m. Therefore, the electroconductive metal oxide and the insulating material can be well dispersed in the slurry and differences in the impedance of the electromagnetic wave absorbing layer at different spots can be eliminated.

In the electromagnetic wave absorber according to the fourth aspect of the present invention, the substrate is composed of a ceramic sintered body having insulating properties and high thermal shock resistance, such as a cordierite sintered body. Therefore, a microwave can be absorbed stably at a wide temperature range without deterioration in the electromagnetic wave absorber such as cracking even when the temperature of the electromagnetic wave absorber rises sharply.

In the electromagnetic wave absorber according to the fifth aspect of the present invention, an intermediate layer made from a metal oxide containing no component which reacts with a metal element component contained in the electromagnetic wave absorbing material at high temperatures is formed between the electromagnetic wave absorbing layer and the substrate. Therefore, a reaction does not occur between the material forming the electromagnetic wave absorbing layer and the material forming the substrate even when the temperature of the electromagnetic wave absorbing material becomes high by the absorption of a microwave. Hence, the microwave heat conversion efficiency of the electromagnetic wave absorber does not deteriorate even at high temperatures.

In the electromagnetic wave absorber according to the sixth aspect of the present invention, a metal oxide containing no Al is used to form the intermediate layer when the electromagnetic wave absorbing layer is made from a material containing Co. Therefore, the composition of the intermediate layer can be limited in advance.

In the electromagnetic wave absorber according to the seventh aspect of the present invention, a metal oxide containing no Si is used to form the intermediate layer when the electromagnetic wave absorbing layer is made from a material containing Mn. Therefore, the composition of the intermediate layer can be limited in advance.

What is claimed is:

1. An electromagnetic wave absorber comprising:

a substrate made from a material which rarely absorbs a microwave and an electromagnetic wave absorbing layer formed on a surface of each barrier of the substrate, wherein the electromagnetic wave absorbing layer is made from a mixture of an electroconductive metal oxide having a perovskite type crystal structure and represented by a formula described below and an insulating material, and the impedance of the electromagnetic wave absorbing layer is adjusted to the impedance of a medium through which the microwave is transmitted such that reflection power ratio becomes 10 dB or more; the formula being $$(A_{1-x}B_x)MO_3$$

wherein, A represents at least one rare-earth metal, B is at least one of Cerium, alkaline-earth metals and Yttrium, M represents at least one of transition metals, and X is a number in a range of $0<X<0.95$.

2. The electromagnetic wave absorber of claim 1, wherein the electromagnetic wave absorbing layer is formed by coating on the surface of the substrate a slurry prepared by mixing 0.1 to 60 wt % of the insulating material powders with the electroconductive metal oxide fine powders in a solvent.

3. The electromagnetic wave absorber of claim 2, wherein the electroconductive metal oxide fine powders have an average particle diameter of 0.1 to 10 $\mu$m and the insulating material powders have an average particle diameter of 0.1 to 500 $\mu$m.

4. The electromagnetic wave absorber of claim 1, wherein the substrate is composed of a ceramic sintered body having insulating properties and high thermal shock resistance, such as a cordierite sintered body.

5. The electromagnetic wave absorber of claim 1, wherein an intermediate layer made from a metal oxide containing no component which reacts with a metal element component contained in the electromagnetic wave absorbing layer at high temperatures is formed between the electromagnetic wave absorbing layer and the substrate.

6. The electromagnetic wave absorber of claim 5, wherein a metal oxide containing no Al or a composite metal oxide of two or more of the metal oxides is used to form the intermediate layer when the electromagnetic wave absorbing layer comprises an electroconductive metal oxide containing Co.

7. The electromagnetic wave absorber of claim 5, wherein a metal oxide containing no Si alumina or ceria, or a composite metal oxide of two or more of the metal oxides is used to form the intermediate layer when the electromagnetic wave absorbing layer comprises an electroconductive metal oxide containing Mn.

* * * * *